United States Patent [19]

Tiberg

[11] 4,030,532

[45] June 21, 1977

[54] METHOD FOR CASTING STEEL INGOTS

[75] Inventor: Lars Tiberg, Fagersta, Sweden

[73] Assignee: Fagersta AB, Fagersta, Sweden

[22] Filed: May 25, 1976

[21] Appl. No.: 689,803

Related U.S. Application Data

[63] Continuation-in-part of Ser. No. 585,766, June 10, 1975, abandoned.

[52] U.S. Cl. ..... 164/66; 164/72; 164/122; 164/125; 249/199

[51] Int. Cl.[2] ..... B22D 7/00

[58] Field of Search ..... 164/122, 123, 124, 133, 164/82, 125, 126, 127, 134, 66, 72; 249/199, 204, 121, 174

[56] References Cited

UNITED STATES PATENTS

| | | | |
|---|---|---|---|
| 967,830 | 8/1910 | Potter | 164/122 |
| 1,485,830 | 3/1924 | Coates | 249/174 X |
| 1,491,846 | 4/1924 | Coates | 164/133 |
| 1,491,881 | 4/1924 | Perry | 249/174 X |
| 1,493,602 | 5/1924 | Coates | 164/125 |
| 3,472,308 | 10/1969 | Lauth | 164/123 X |
| 3,526,265 | 9/1970 | Nomura et al. | 164/122 X |

FOREIGN PATENTS OR APPLICATIONS

| | | | |
|---|---|---|---|
| 2,253,945 | 5/1974 | Germany | 164/122 |
| 20,733 | 9/1969 | Japan | 164/122 |

*Primary Examiner*—Ronald J. Shore
*Assistant Examiner*—Gus T. Hampilos
*Attorney, Agent, or Firm*—Lerner, David, Littenberg & Samuel

[57] ABSTRACT

A method for casting steel ingots in molds is provided wherein the upper surface of the ingot is caused to solidify before the interior of the ingot is solidified in order to provide an improved ingot having sound and homogeneous material over all the surfaces of the ingot and a good distribution of segregates throughout the cross section of the ingot. In the improved method, the surface temperature of the upper surface of the ingots is maintained at or near the liquidus temperature of the steel being casted for at least 10 seconds after casting so that the upper surface of the ingot remains fluid to allow slag inclusions to float to the upper surface of the ingot. The upper surface of the ingot is then solidified between 10 seconds and 2 minutes after casting by lowering the surface temperature of the ingot to a temperature at or near the solidus temperature of the steel so that the upper surface of the ingot solidifies before the interior of the ingot is solidified. The upper surface of the ingot is then maintained at or near the solidus temperature so that the upper surface of the ingot will deform plastically and sink downwards when the interior of the ingot solidifies and shrinks.

13 Claims, 2 Drawing Figures

METHOD FOR CASTING STEEL INGOTS

This application is a continuation-in-part of application Ser. No. 585,766, filed June 10, 1975 and now abandoned.

FIELD OF THE INVENTION

The present invention relates generally to an improved method for casting steel ingots in molds, and specifically to an improved method which causes the upper surface of the molded ingot to solidify before the interior of the ingot is solidified to provide a steel ingot having improved characteristics.

BACKGROUND OF THE INVENTION

Casting steel in the form of conventional ingots involves high costs for processing the ingots to billets. Moreover, since killed steels are cast as ingots with a sinkhead, there is a yield loss of 10 percent to 20 percent when the sinkhead is removed in processing. Accordingly, to avoid the high-processing costs and large yield losses which are connected with processing conventional ingots, continuous steel casting has been increasingly used. However, high-alloy steels, such as the steel used in tools, and ball bearing steels, are not suitable for continuous casting because of the segregates which form when steels having large solidification intervals are cast continuously.

The forming of segregates in continuous casting occurs because of the shape of the solidification front. More particularly, during the solidification interval, a solidified shell is formed, and on the inside of the shell, a semi-solidified structure of dendrites is formed interspersed with residual melt. The interior of the shell shrinks during the solidification process, and the shrinkage is compensated by residual melt being pressed into the interior of the shell. This causes stresses to occur in the dentritic network and it finally ruptures. The ruptures or cracks are then filled with residual melt and segregates are formed. Segregates can be avoided if the continuous casting process is carried out extremely slowly so that the solidification front has a favorable shape. However, such a process is uneconomical because of the very slow casting rates.

Broadly, it is an object of the present invention to provide an improved method for casting steel ingots which overcomes the aforesaid problems. Specifically, it is within the contemplation of the present invention to provide an improved method which causes the upper surface of the ingot to solidify before the interior of the ingot is solidified and maintains the upper surface of the ingot at a sufficiently high temperature so that it may deform plastically and sink downwards when the interior of the ingot solidifies and shrinks.

It is a further object of the present invention to provide an improved method for casting steel ingots in molds in which the ingots have substantially uniform chemical composition throughut their cross section and a substantially uniform distribution of segregates throughout their cross section, rather than being concentrated at the upper surface of the ingot.

SUMMARY OF THE INVENTION

Briefly, in accordance with the principles of the present invention, an improved method for casting steel ingots in molds is provided which includes the steps of pouring the steel into elongated, horizontal molds having an open upper surface in order to form the ingots.

While the steel is being poured, the molds are moved longitudinally past a casting tundish at a uniform rate. The surface temperature of the molded ingots is maintained in the range of 40° C below, preferably 20° C below, the liquidus temperature to 50° C above the liquidus temperature of the steel being cast for at least 10 seconds after casting so that the upper surface of the ingots remains fluid to allow slag inclusions to float to the upper surface of the ingots. The upper surfaces of the ingots are then solidified between 10 seconds and 2 minutes after casting by lowering their surface temperatures to a temperature between the solidus temperature of the steel and a temperature 100° C below the solidus temperature with the solidifying of the upper surface to occur before the interior of the ingots is solidified. The solidified upper surfaces of the ingots are then maintained at a temperature between the solidus temperature of the steel and a temperature 200° C below the solidus temperature so that the upper surfaces are sufficiently hot to deform plastically and sink downwards when the interior of the ingots solidify and shrink.

Accordingly, in the present invention, the upper surface of the ingot is solidified before the interior of the ingot is solidified, whereas in prior art methods, it was generally the practice to cause the upper surfaces of the ingots to solidify last, that is, after the interior of the ingot was solidified. However, such prior art methods have a number of disadvantages which are overcome by the present invention. More particularly, the solidification time and energy consumption required by the present method are much less and, therefore, much more economical than the aforesaid prior art methods. In addition, the ingots produced by the improved method of the present invention have superior and more uniform chemical composition throughout their cross section, whereas the ingots produced by the prior art methods do not have symmetrical or uniform chemical composition. In addition, in the prior art methods, which caused the upper surface of the ingots to solidify last, the segregates were formed and concentrated at the upper surface of the ingots, with the upper surface having large grain sizes and poor surface characteristics.

In addition, in accordance with the method of the present invention, the surface of the ingots is protected from oxidation and decarbonization in a protective atmosphere of inert gas which may be either argon or nitrogen. Moreover, the use of a protective atmosphere in the method of the present invention also provides additional advantages. That is, the detrimental effect of cold laps is reduced, and in addition, the surface tension of the steel is increased, and thus, the characteristics of the upper surfaces of the ingots are improved.

BRIEF DESCRIPTION OF THE DRAWINGS

Further objects, features, and advantages of the present invention will become apparent upon the consideration of the following detailed description of a presently-preferred embodiment when taken in conjunction with the accompanying drawing, wherein.

DETAILED DESCRIPTION OF PREFERRED EMBODIMENT OF THE INVENTION

Figure 1:
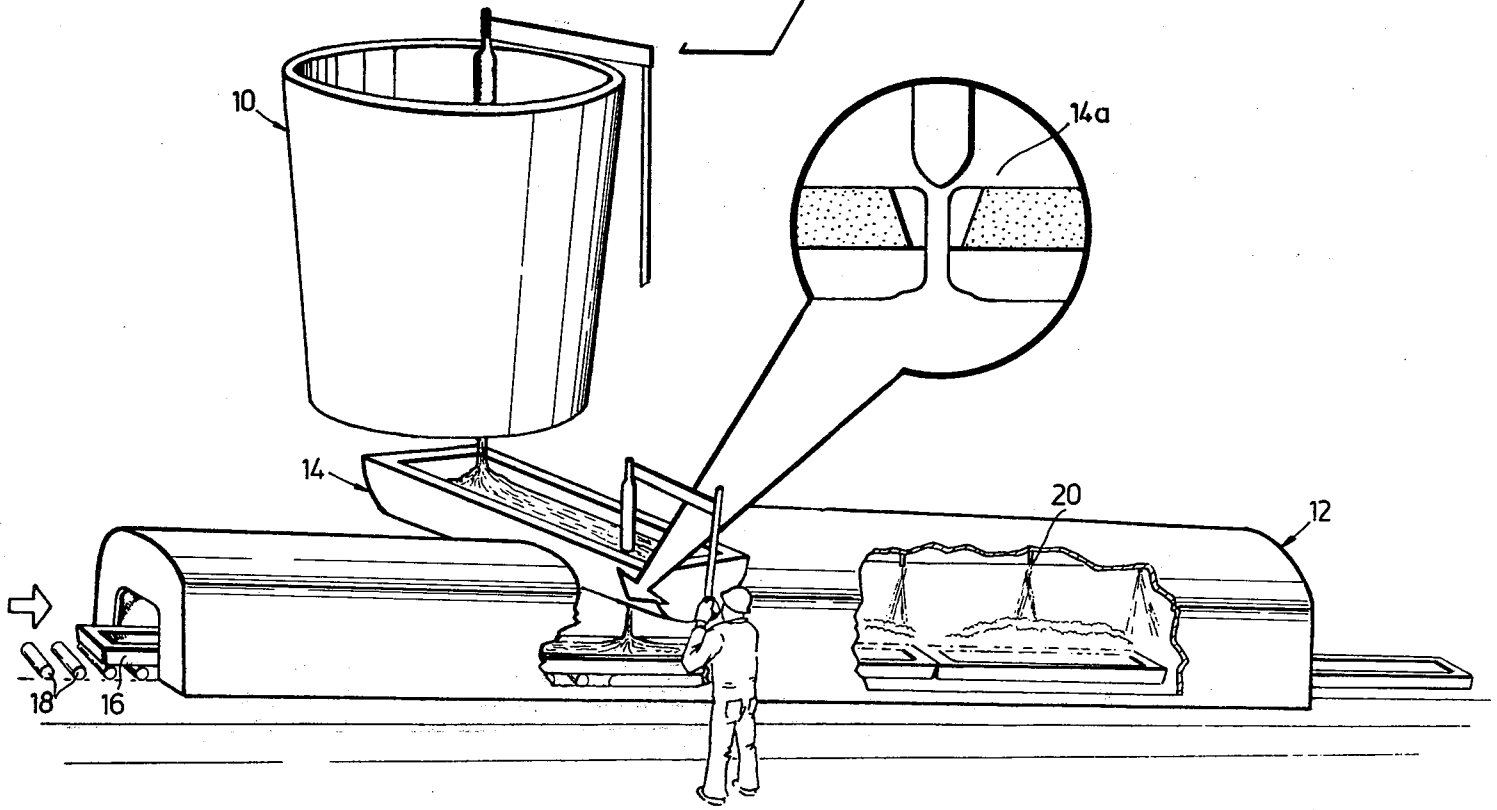
FIG. 1 is a diagrammatic illustration of the various steps practiced in accordance with the method of the present invention.

A more detailed description of the method of the present invention can be obtained by referring to FIG. 1 which illustrates casting apparatus employed for performing the method according to the present invention. The steel to be cast is contained in a ladle 10, and the casting apparatus includes a closed tunnel 12 upon which a tundish 14 is placed. Cast-iron molds 16 move through tunnel 12 from left to right on rollers 18. Protective gas, such as nitrogen or argon, is fed into the tunnel 12. Disposed in tunnel 12 are high-power infrared tungsten-halogen lamps 20 which supply heat to the molds 16 as they pass thereunder. Typically, the heating zone is normally 10 meters to 40 meters in length. In addition, in the preferred embodiment, tunnel 12 is provided with locks or seals at both ends to prevent air from leaking into the tunnel. Preferably, there is also a seal, such as a sand lock, between tundish 14 and tunnel 12 disposed about nozzle 14a of the tundish.

The method according to the present invention is carried out as follows. The steel to be cast is poured from ladle 10 to tundish 14. The molds 16 are preheated and precoated and moved through tunnel 12 at a uniform speed. As molds 16 pass below nozzle 14a, the steel is poured into the molds 16. The molds 16 move longitudinally under the tundish 14, and the constant movement prevents the steel from burning and sticking to molds 16. A weighing system is provided in the rollers 18 which provides a continuous control of the weight of the steel which is poured into the molds 16. In this manner, the ingot size is maintained substantially constant, since the amount of steel poured into each mold is substantially the same. Next, the molds 16 filled with the steel move under the heating lamps 20.

Figure 2:
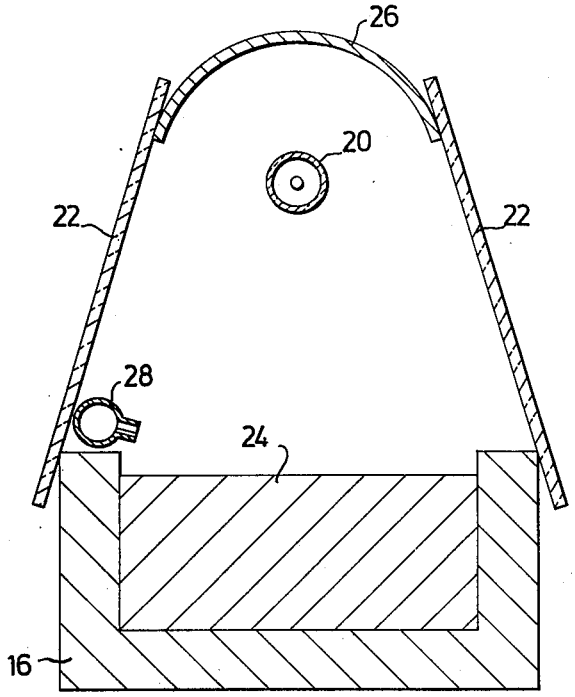
FIG. 2 is a cross-sectional view illustrating the application of heat to the upper surface of an ingot disposed in a mold.

As shown in FIG. 2, which is a section through tunnel 12, heat shields 22 are disposed between lamps 20 and molds 16 to allow the heat from lamps 20 to be concentrated on the molds and to prevent heat dissipation. In the preferred embodiment, molds 16 are provided with a rectangular cross section and a width-depth relationship to about 2:1. The upper surface of ingot 24 in molds 16 is heated by lamps 20, and a reflector 26 is provided to reflect the heat against the upper surface of ingot 24. Heat shields 22, which can include reflectors and insulators, may consist of asbestos sheets disposed on both sides of lamps 20.

In addition, to protect the upper surface of ingot 24 from oxidation and decarbonization, an inert gas, such as argon or nitrogen, is introduced from a supply duct 28 disposed adjacent one side of molds 16. As a result of such protective gas shielding during casting, an ingot is obtained having a clean upper surface having no blisters. As a result of casting in argon or nitrogen, an ingot skin is obtained which is practically free from oxides. By mixing in reducing gases, such as hydrogen, into the protective gas atmosphere, the tendency for oxide formation on the surface of the ingot is further reduced. Surface tension of the ingot is also increased as a result of such protective gas atmosphere which contributes to further improving the smoothness of the upper surface of the ingot. A smooth homogeneous upper ingot surface is thereby obtained which does not rupture during hot processing. In addition, by coating the surface of the molds 16 with a coating agent, an even smoother surface can be obtained on the ingot.

Accordingly, compared with conventional ingot casting, the casting method of the present invention provides greater yield from molten steel to finished rolled goods. In addition, compared with continuous casting, the method of the present invention requires substantially less investment cost. The present method is, therefore, of interest not only for steel which is sensitive to segregation, but for all kinds of steel and metals.

For casting tool steels, high-speed steels, stainless steels, and ball racer steels according to the method of the present invention, the following data provide a preferred embodiment:

Ingot size: 160 × 100 × 3000 mm (width × height × length)
Mold preheating temperature: 150° C
Steel temperature in ladle: 40° C above liquidus temperature
Mold speed: 6 m/minute
Heat influx: 50 kW/meter (along the tunnel)
Heating time: 3 minutes
Length of heating zone: 18 meters
Total heating capacity of the machine: 900 kW
Casting speed: 700 kilos/minute In accordance with the method of the present invention, the upper surface of the ingot shall remain fluid for at least 10 seconds after casting to allow slag inclusions to float up to the surface. Next, solidification of the upper surface of the ingot should take place between 10 seconds and 2minutes after casting. If the surface solidifies more than 2 minutes after casting, the center of solidification will be too close to the upper surface. After solidification of the upper surface of the ingot, the upper surface shall be maintained sufficiently hot so that it can deform plastically and sink downwards when the interior of the ingot solidifies and shrinks.

In the preferred embodiment, the surface tempeature of the ingot is maintained in the range of 20° C below the liquidus temperature to 50° C above the liquidus temperature of the steel being molded for at least 10 seconds after casting so that the upper surface of the ingot remains fluid to allow slag inclusions to float to the upper surface. Next, the upper surface of the ingot is solidified between 10 seconds and 2 minutes after casting by lowering the surface temperature of the ingot to a temperature between the solidus temperature of the steel being molded and a temperature 100° C below the solidus temperature. In addition, the solidifying of the upper surface must occur before the interior of the ingot is solidified. Then, the solidified upper surface of the ingot is maintained at a temperature between the solidus temperature and a temperature 200° C below the solidus temperature so that the upper surface is sufficiently hot to deform plastically and sink downwards when the interior of the ingot solidifies and shrinks.

In addition, in order to obtain best results, the molds 16 are preheated to a temperature in the range of 50° to 200° C before the steel is poured into the molds. Further, for best results, the molds 16 should have a width-depth ratio in the range of 1:1 to 10:1. Further, molds 16 should preferably be moved past casting tundish 14 at a uniform rate in the range of 1 meter to 20 meters per minute. Moreover, to avoid surface defects on the ingots, the interior of molds 16 should be coated. Preferably, the weight of the steel poured into the molds should be conrolled and maintained in the range of 25 kilos to 1,000 kilos.

It should also be noted that for most steels molded in accordance with the present invention, that the surface temperature of the ingots should be maintained in the range of 1,400° to 1,580° C for at least 10 seconds after casting. In addition, it is preferable to cut off the heat supply to the upper surface of the ingot before the solidification of the interior of the ingot has been completed so that the carbide structure in the solidification center is made more fine.

It should also be noted that employing a protective atmosphere in accordance with the method of the present invention provides additional advantages as compared to earlier casting processes. Typically, the protective gas atmosphere prevents oxidation of the steel and prevents the formation of oxide inclusions and blowholes. However, such protective gas atmospheres also provides two additional advantages in the present invention. First, it reduces the detrimental effect of cold laps and also increases the surface tension of the steel and thereby improves the characteristics of the upper surface of the ingots produced.

A latitude of modification, change, and substitution is intended in the foregoing disclosure and, in some instances, some features of the invention will be employed without a corresponding use of other features. Accordingly, it is apropriate that the appended claims be construed broadly and in a manner consistent with the spirit and scope of the invention herein.

What is claimed is:

1. A method for casting steel ingots in molds comprising the steps of:

pouring the steel into elongated horizontal moldshaving an open upper surface to form ingots;

moving said molds longitudinally under a casting tundish at a uniform rate during casting;

maintaining the surface temperature of said ingots in the range of 40° below the liquidus temperature to 50° above the liquidus temperature of the steel for at least 10 seconds after casting so that the upper surface of said ingots remains fluid to allow slag inclusions to float to said upper surface;

solidifying said upper surface of said ingots between 10 seconds and 2 minutes after casting by lowering the ingot surface temperature to a temperature between solidus temperature and a temperature 100° C below solidus temperature, the solidifying of said upper ingot surface to occur before the interior of said ingot is solidified; and maintaining said solidified upper surface at a temperature between the solidus temperature and a temperature 200° C below solidus temperature so that said upper surface is sufficiently hot to deform plastically when the interior of the ingot solidifies and shrinks to thereby reduce the formation of pores or segregates in the ingots.

2. The method for casting steel ingots in accordance with claim 1 wherein said molds are preheated to a temperature in the range of 50° to 200° C before the steel is poured into said molds.

3. The method for casting steel ingots in accordance with claim 1 including the step of employing molds having a width/depth ratio in the range of 1:1 to 10:1.

4. The method for casting steel ingots in accordance with claim 1 wherein said molds are removed under the casting tundish at a uniform rate in the range of 1 to 20 meters per minute.

5. The method for casting steel ingots in accordance with claim 1 including the step of protecting the surface of said ingots from oxidation and decarbonization in a protective atmosphere of inert gas selected from the group consisting of argon and nitrogen.

6. The method for casting steel ingots in accordance with claim 1 further including the step of coating the interior of said molds before casting to avoid the formation of surface defects on said ingots.

7. The method for casting steel ingots in accordance with claim 1 further including the step of controlling the weight of steel poured into said molds and maintaining said weight in the range of 25 to 1,000 kilos.

8. The method in accordance with claim 1 wherein the surface temperature is maintained in the range of 1,400° to 1,580° C for at least 10 seconds after casting to allow slag inclusions to float to said upper ingot surface.

9. The method in accordance with claim 1 wherein the molds are moved under a heat source after casting for supplying heat to the upper surface of the ingots.

10. The method in accordance with claim 9 wherein the heat supply to the upper ingot surface is discontinued before the solidification of the interior of the ingot is completed.

11. The method in accordance with claim 1 wherein the molds are moved under a heat-insulating means after casting to reduce heat dissipation.

12. The method in accordance with claim 11 wherein the ingot is moved away from said heat-insulating means before the solidification of the interior of the ingot is completed.

13. The method in accordance with claim 1 wherein the surface temperature of said ingots is maintained in the range of 20° C below the liquidus temperature to 50° C above the liquidus temperature of the steel for at least 10 seconds after casting so that the upper surface of said ingots remains fluid to allow slag inclusions to float to said upper surface.

* * * * *

UNITED STATES PATENT OFFICE

CERTIFICATE OF CORRECTION

Patent No. 4,030,532 Dated June 21, 1977

Inventor(s) Lars Tiberg

It is certified that error appears in the above-identified patent and that said Letters Patent are hereby corrected as shown below:

Column 3, line 43, "to" should read -- of --.

Column 6, line 8, after "1" and before "including" insert -- further --.

Signed and Sealed this

Eleventh Day of October 1977

[SEAL]

Attest:

RUTH C. MASON
Attesting Officer

LUTRELLE F. PARKER
Acting Commissioner of Patents and Trademarks